US005609025A

United States Patent [19]

Abe

[11] Patent Number: 5,609,025

[45] Date of Patent: Mar. 11, 1997

[54] AIR-FUEL RATIO CONTROL DEVICE FOR INTERNAL COMBUSTION ENGINE

[75] Inventor: Shinichi Abe, Aichi-gun, Japan

[73] Assignee: Toyota Jidosha Kabushiki Kaisha, Aichi, Japan

[21] Appl. No.: 565,507

[22] Filed: Nov. 30, 1995

[30] Foreign Application Priority Data

Dec. 2, 1994 [JP] Japan ..... 6-299584

[51] Int. Cl.[6] ..... F01N 3/00

[52] U.S. Cl. ..... 60/285; 60/276

[58] Field of Search ..... 60/276, 277, 285

[56] References Cited

U.S. PATENT DOCUMENTS

| | | | |
|---|---|---|---|
| 5,331,808 | 7/1994 | Koike | 60/277 |
| 5,337,558 | 8/1994 | Komatsu | 60/277 |
| 5,414,996 | 5/1995 | Sawada et al. | 60/277 |
| 5,433,074 | 7/1995 | Seto et al. | 60/285 |
| 5,533,332 | 7/1996 | Uchikawa | 60/277 |

FOREIGN PATENT DOCUMENTS 3-217634 9/1991 Japan .

*Primary Examiner*—John T. Kwon
*Attorney, Agent, or Firm*—Kenyon & Kenyon

[57] ABSTRACT

An air-fuel ratio control device is for an internal combustion engine having a fuel injector and a catalytic converter, with an $O_2$ storage ability, arranged in an exhaust passage. The device comprises a first air-fuel ratio detector for detecting an air-fuel ratio in an exhaust gas upstream of the catalytic converter and a second air-fuel ratio detector for detecting an air-fuel ratio in exhaust gas downstream of the catalytic converter. The device controls an amount of injected fuel on the basis of an output of the first air-fuel ratio detector, and corrects a standard output of the first air-fuel ratio detector corresponding to the stoichiometric air-fuel ratio by a correction value determined on the basis of a difference between an air-fuel ratio detected by the second air-fuel ratio detector and the stoichiometric air-fuel ratio. Moreover, the device changes the correction value such that the lower a current $O_2$ storage ability is, determined on the basis of a variable which varies in accordance with the current $O_2$ storage ability, the smaller said correction value becomes.

5 Claims, 4 Drawing Sheets

AIR-FUEL RATIO CONTROL DEVICE FOR INTERNAL COMBUSTION ENGINE

BACKGROUND OF THE INVENTION

1. Field of the Invention

The present invention relates to an air-fuel ratio control device for an internal combustion engine, which device carries out an air-fuel ratio feed-back control using a first air-fuel ratio detector arranged upstream of a catalytic converter, and a second air-fuel ratio detector arranged downstream thereof, in the exhaust system.

2. Description of the Related Art

An exhaust system of an internal combustion engine is usually provided with a three-way catalytic converter which oxidizes CO and HC, and deoxidizes $NO_x$ so that these three harmful materials in the exhaust gas are converted into harmless materials, as $CO_2$, $H_2O$, and $N_2$. The purifying ability of the three-way catalyst depends on an air-fuel ratio of the mixture in an engine cylinder, and it is known that when the air-fuel ratio is stoichiometric, the three-way catalyst can purify all of these three harmful materials at the same time. To counter a variation of the air-fuel ratio, the three-way catalyst usually has an $O_2$ storage ability such that it absorbs and stores excess oxygen existing in the exhaust gas when the mixture is on the lean side, and it releases oxygen when the mixture is on the rich side.

An air-fuel ratio control device which has a first air-fuel ratio detector arranged upstream of the catalytic converter and a second air-fuel ratio detector arranged downstream thereof in the exhaust system, is known. The device corrects a target amount of injected fuel, determined from the current engine operating condition, on the basis of a difference between the air-fuel ratio upstream of the catalytic converter detected by the first air-fuel ratio detector and the stoichiometric air-fuel ratio.

In the air-fuel ratio control device, a standard output of the first air-fuel ratio detector corresponding to the stoichiometric air-fuel ratio is corrected, on the basis of a difference between the air-fuel ratio downstream of the catalytic converter detected by the second air-fuel ratio detector and the stoichiometric air-fuel ratio.

In such air-fuel ratio control device, the air-fuel ratio downstream of the catalytic converter usually varies only within a relative small range due to the $O_2$ storage ability of the catalytic converter. However, once the catalytic converter deteriorates and thus the $O_2$ storage ability thereof drops, the air-fuel ratio downstream of the catalytic converter begins to vary within a relative large range as does the air-fuel ratio upstream thereof. When the standard output of the first air-fuel ratio detector is corrected as the above-mentioned, a correction value is determined on the assumption that the air-fuel ratio detected by the second air-fuel ratio detector varies only within the small range. Accordingly, once the catalytic converter deteriorates, the correction value is made relatively large in spite of a normal variation of the air-fuel ratio upstream of the catalytic converter and thus hunting of the air-fuel ratio in the engine cylinder can be caused.

Japanese Unexamined Patent Publication No. 3-217634 discloses an air-fuel ratio control device which makes the air-fuel ratio vary with the stoichiometric air-fuel ratio as a center line, on the basis of the output of the first air-fuel ratio detector. To be concrete, the device makes a correction factor for correcting an amount of injected fuel increase by a rich skip amount and then gradually increase by a rich integration amount when an output of the first air-fuel ratio detector has changed from the rich side to the lean side. The device makes the correction factor decrease by a lean skip amount and then gradually decrease by a lean integration amount when an output of the first air-fuel ratio detector has changed from the lean side to the rich side. The device makes the skip amounts or the integration amounts change to correct the standard output of the first air-fuel ratio detector, on the basis of the output of the second air-fuel ratio detector. Moreover, the device comprises detection means for detecting a deterioration of the catalytic converter. The device forces the skip amounts or the integration amounts become small when the catalytic converter deteriorates, to prevent hunting of the air-fuel ratio.

However, when the catalytic converter deteriorates, the standard output of the first air-fuel ratio detector is not corrected precisely so that combustion deteriorates. Moreover, the $O_2$ storage ability of the catalytic converter also drops when the catalyst is not activated. Accordingly, when the catalyst is not activated, the device does not forces the skip amounts or the integration amounts to become small so that hunting of the air-fuel ratio can still be caused.

SUMMARY OF THE INVENTION

Therefore, an object of the present invention is to provide an air-fuel ratio control device capable of accurately correcting the standard output of the first air-fuel ratio detector arranged upstream of the catalytic converter on the basis of the output of the second air-fuel ratio detector arranged downstream thereof and of preventing the air-fuel ratio hunting, when the catalyst deteriorates or is not activated.

According to the present invention, there is provided an air-fuel ratio control device for an internal combustion engine having a fuel injector and a catalytic converter with an $O_2$ storage ability arranged in an exhaust passage, comprising: a first air-fuel ratio detector, for detecting an air-fuel ratio in exhaust gas, which is arranged in the exhaust passage upstream of the catalytic converter; a second air-fuel ratio detector for detecting an air-fuel ratio in exhaust gas, which is arranged in the exhaust passage downstream of the catalytic converter; control means for controlling an amount of fuel injected by the fuel injector on the basis of an output of the first air-fuel ratio detector; correction means for correcting a standard output of the first air-fuel ratio detector corresponding to the stoichiometric air-fuel ratio by a correction value determined on the basis of a difference between an air-fuel ratio detected by the second air-fuel ratio detector and the stoichiometric air-fuel ratio; and changing means for changing the correction value such that the lower the current $O_2$ storage ability is, determined on the basis of a variable which varies in accordance with the current $O_2$ storage ability, the smaller the correction value becomes.

The present invention will be more fully understood from the description of preferred embodiments of the invention set forth below, together with the accompanying drawings.

DESCRIPTION OF PREFERRED EMBODIMENTS

Figure 1:
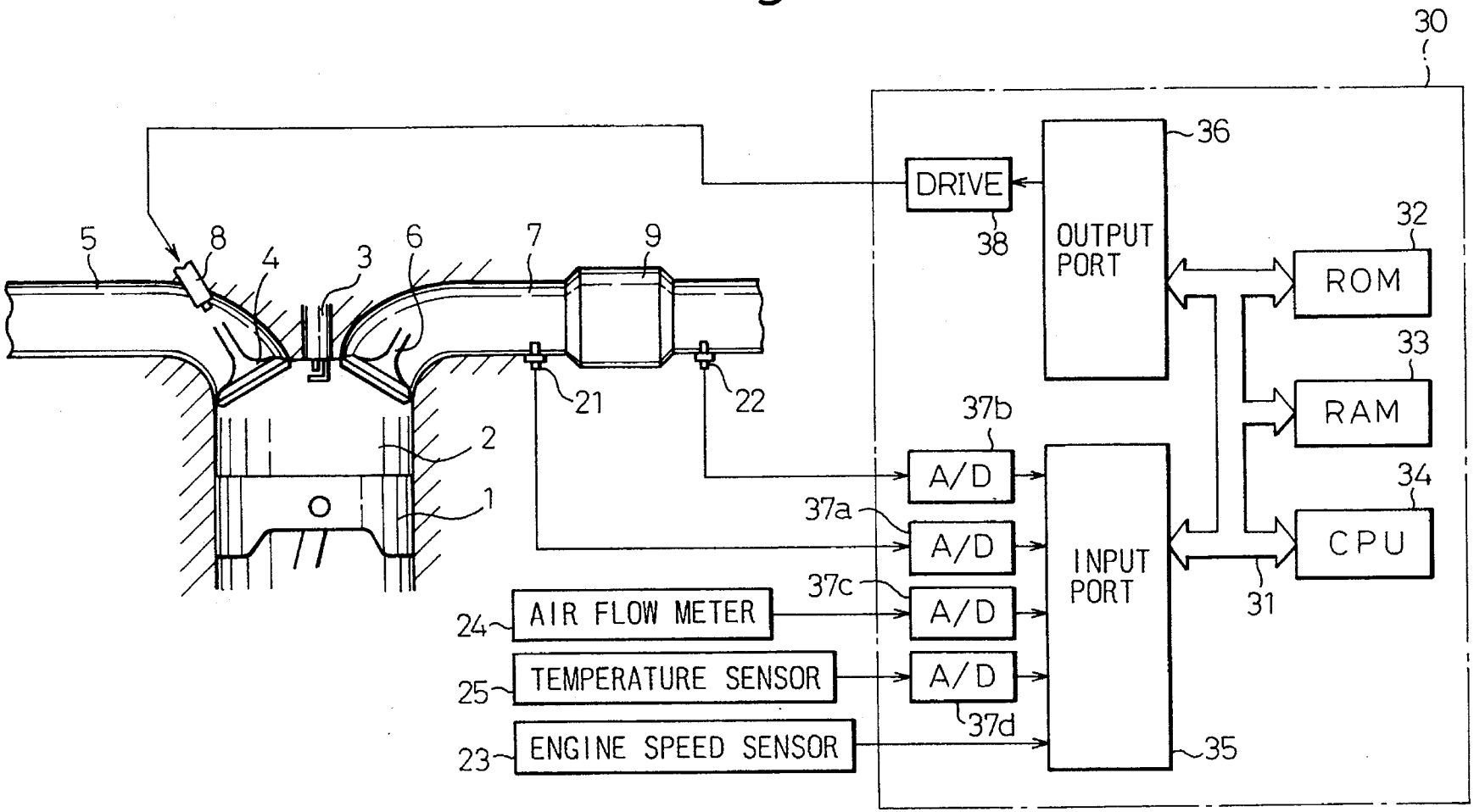
FIG. 1 is a sectional view of an internal combustion engine with an air-fuel ratio control device according to the present invention.

FIG. 1 is a sectional view of an internal combustion engine with an air-fuel ratio control device according to the present invention. Referring to FIG. 1, reference numeral 1 designates a piston, 2 a combustion chamber, 3 an ignition plug. An intake passage 5 and an exhaust passage 7 are connected to the combustion chamber 2, via an intake valve 4 and an exhaust valve 6, respectively. A fuel injector 8 is arranged in every intake passage 5.

A three-way catalytic converter 9 is arranged in the exhaust passage 7, which converter oxidizes CO and HC, and deoxidizes $NO_x$. The three-way catalytic converter 9 has an $O_2$ storage ability such that it absorbs and stores excess oxygen existing in the exhaust gas when the mixture is on the lean side, and it releases oxygen when the mixture is on the rich side. A first air-fuel ratio detector 21 is arranged in the exhaust passage 7 upstream of the three-way catalytic converter 9 and a second air-fuel ratio detector 22 is arranged in the exhaust passage 7 downstream of the three-way catalytic converter 9. The first air-fuel ratio detector 21 is a linear-output type and produces an output voltage which is proportional to the air-fuel ratio in the exhaust gas. The second air-fuel ratio detector 22 is a step-output type and produces an output voltage which varies rapidly when the air-fuel ratio in the exhaust gas is nearly stoichiometric.

Reference numeral 30 designates an electronic control unit (ECU) for controlling an amount of fuel injected by the fuel injector 8, i.e., the air-fuel ratio in the mixture. The ECU 30 is constructed as a digital computer and includes a ROM (read only memory) 32, a RAM (random access memory) 33, a CPU (microprocessor, etc.) 34, an input port 35, and an output port 36, which are interconnected by a bidirectional bus 31. The output voltages of the first and second air-fuel ratio detectors 21, 22 are input into the input port 35 via an AD converters 37*a*, 37*b*, respectively. An engine speed sensor 23, which produces an output pulse representing the engine speed, is connected to the input port 35. An air flow meter 24 produces an output voltage which is proportional to the amount of air fed into the engine cylinder, and this output voltage is input into the input port 35 via an AD converter 37*c*. A temperature sensor 25 produces an output voltage which is proportional to the temperature of the engine cooling water, and this output voltage is input into the input port 35 via an AD converter 37*d*. The output port 36 is connected to each fuel injector 8 via a drive circuit 38.

Figure 2:
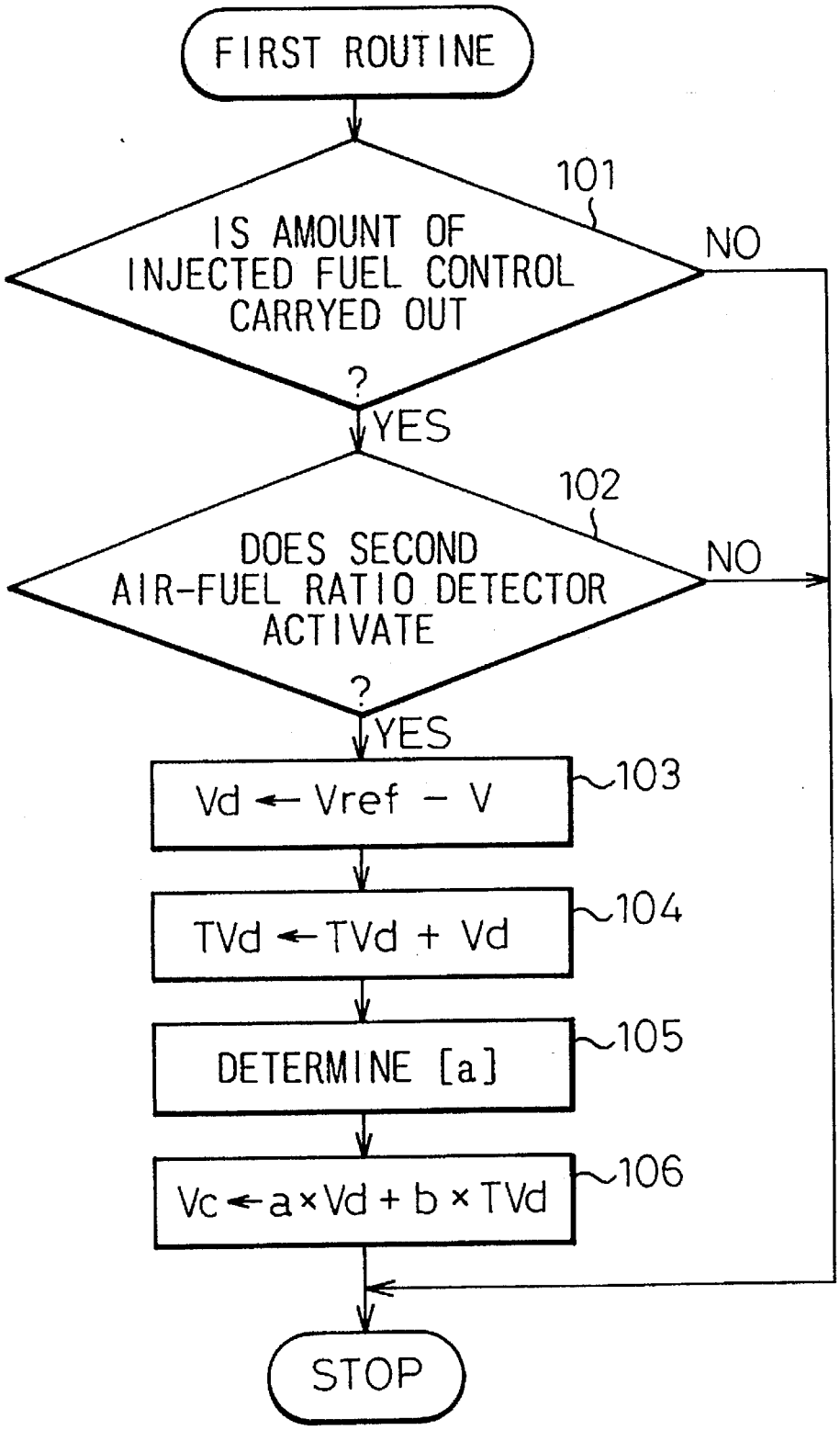
FIG. 2 is a first routine for determining a correction voltage of the first air-fuel ratio detector.

The ECU 30 controls the amount of injected fuel by the fuel injector 8, as follows. First, a target amount of fuel is decided to realize the stoichiometric air-fuel ratio on the basis of a current amount of intake air detected by the air flow meter 24. Next, the target amount of fuel is corrected on the basis of the difference between a current air-fuel ratio detected by the first air-fuel ratio detector 21 and the stoichiometric air-fuel ratio, and thus an actual amount of fuel injected by the fuel injector 8 is decided. Such amount of fuel control requires a high reliability in the output of the first air-fuel ratio detector 21, in particular the standard output thereof corresponding to the stoichiometric air-fuel ratio. Accordingly, the standard output must be corrected according to a first routine shown in FIG. 2. In the correction, the second air-fuel ratio detector 22 is used, which does not deteriorate, in contrast to the first air-fuel ratio detector 21, because the second air-fuel ratio detector 21 is arranged downstream of the three-way catalytic converter 9 and is exposed only to the purified exhaust gas.

The first routine is started simultaneously with the engine starting and is repeated at every predetermined period. First, at step 101, it is determined if the above-mentioned amount of fuel control which uses the first air-fuel ratio detector 21 is carried out. When the result is positive, the routine goes to step 102 and it is determined if the second air-fuel ratio detector 22 is activated. In the determination at step 102, the temperature of the engine cooling water detected by the temperature sensor 32 as the engine temperature is utilizable. When the result at step 101 is negative, the standard output of the first air-fuel ratio detector 21 need not be correct. When the result at step 102 is negative, the ECU 30 cannot correct the standard output on the basis of the output of the second air-fuel ratio detector 22. In these cases, the routine is stopped.

When the result at step 102 is positive, i.e., when the second air-fuel ratio detector 22 activates, the routine goes to step 103 and a difference [Vd] between the standard voltage [Vref] (for example, 0.45 V) corresponding to the stoichiometric air-fuel ratio of second air-fuel ratio detector 22 and a current output voltage [V] thereof is calculated. The routine goes to step 104 and an accumulation [TVd] of the differences [Vd] is calculated. The accumulation [TVd] is reset to [0] when the engine is stopped.

Figure 3:
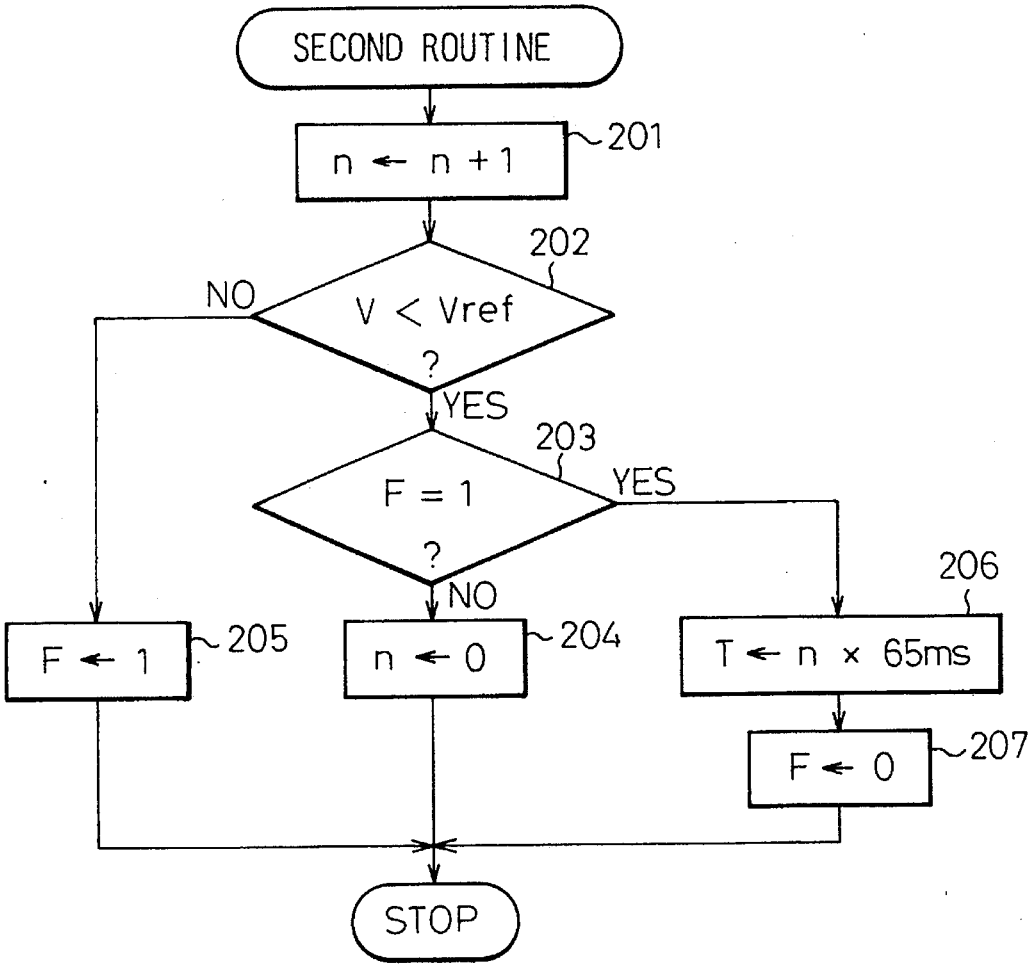
FIG. 3 is a second routine for determining an output reverse period of the second air-fuel ratio detector.
Figure 4:
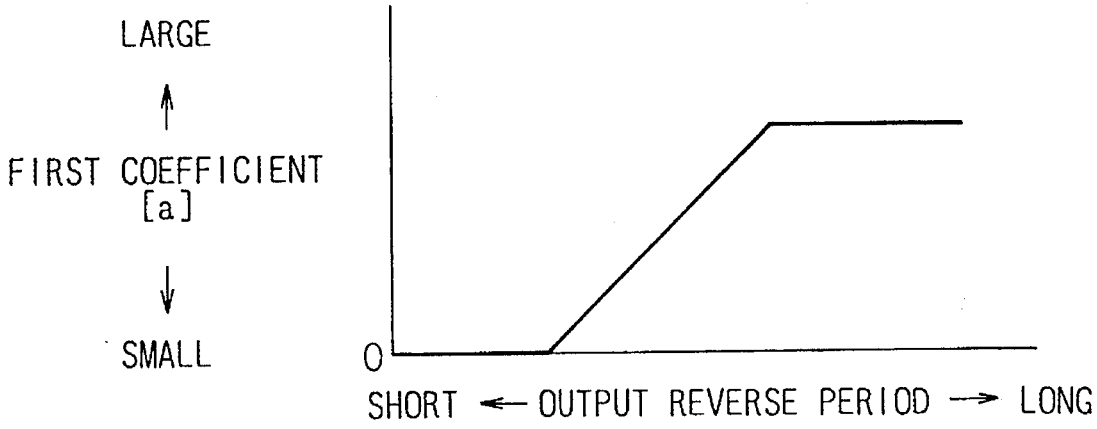
FIG. 4 is a map for determining a first coefficient used in the first routine.

Next, the routine goes to step 105 and a first coefficient [a] is determined from a map, shown in FIG. 4, on the basis of a current output reverse period [T] of the second air-fuel ratio detector 22 determined by a second routine shown in FIG. 3. In the map, a first coefficient [a] is [0] when an output reverse period [T] is relative short, and the longer the output reverse period [T] is, the larger the first coefficient [a] is, and the first coefficient [a] is a predetermined value when the output reverse period [T] is relatively long.

Here, the second routine shown in FIG. 3 is explained. The second routine is started simultaneously with the engine starting and is repeated at predetermined intervals of, for example, 65 ms. First, at step 201, a count value [n], which is reset to [0] when the engine is stopped, is increased by [1]. The routine goes to step 202 and it is determined if a current output voltage [V] of the second air-fuel ratio detector 22 is lower than the standard voltage [Vref] corresponding to the stoichiometric air-fuel ratio thereof. When the result is positive, i.e., when the air-fuel ratio in exhaust gas downstream of the three-way catalyst is on the lean side, the routine goes to step 203 and it is determined if a flag [F] is [1].

The flag [F] is reset to [0] when the engine is stopped. Accordingly, the result at step 203 is negative and the routine goes to step 204. The count value [n] is reset to [0]. While the air-fuel ratio in exhaust gas downstream of the three-way catalytic converter 9 is on the lean side, this flow is repeated and thus the count value [n] is kept to [0]. On the other hand, when the air-fuel ratio in exhaust gas downstream of the three-way catalytic converter 9 become rich, the result at step 202 is negative and the routine goes to step 205. The flag [F] is made [1] and the routine is stopped. While the air-fuel ratio in exhaust gas downstream of the three-way catalytic converter 9 is on the rich side, the count value [n] is increased by [1] every time the second routine repeats.

Once the air-fuel ratio in exhaust gas downstream of the three-way catalytic converter 9 reverses to the lean side, the result at step 202 is positive and the routine goes to step 203. At this time, the flag [F] is [1] so that the result at step 203 is positive and the routine goes to step 206. The current count value [n] multiplied by the predetermined interval [65 ms] of the second routine makes the output reverse period [T]. Next, at step 207, the flag [F] is made [0] and the routine is stopped.

Figure 5:
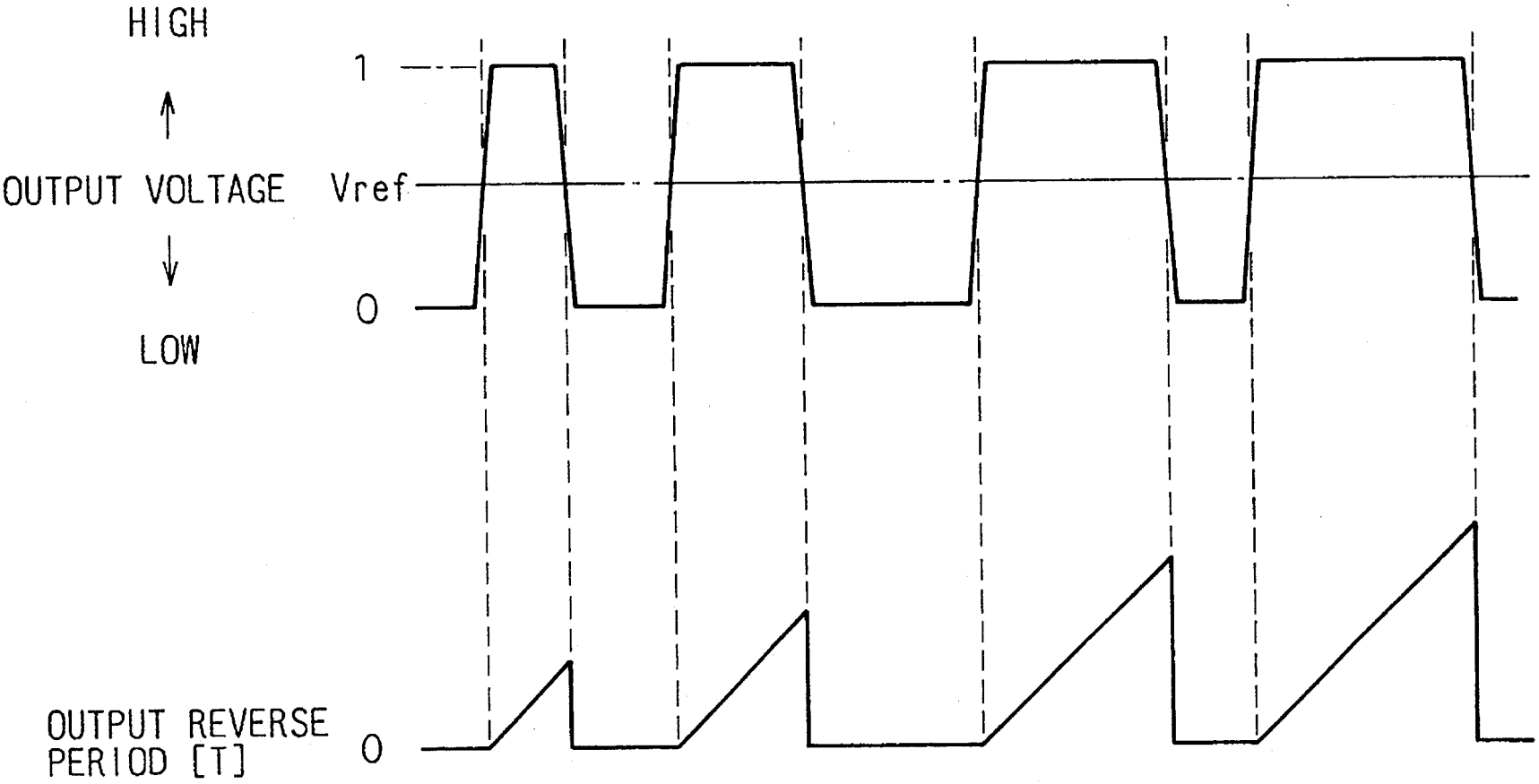
FIG. 5 is a time chart showing variations of an output voltage of the second air-fuel ratio detector and an output reverse period thereof.

According to the second routine, as shown in FIG. 5, a time while the air-fuel ratio in exhaust gas downstream of the three-way catalytic converter 9 is on the rich side is renewed as the current output reverse period [T].

To return to the first routine, at step 105, the first coefficient [a] is determined from the map shown in FIG. 4, on the basis of the current output reverse period [T]. Next, at step 106, a correction voltage [Vc] of the first air-fuel ratio detector 21 is calculated using an expression (1). Here, [b] is a constant and is a relatively small value.

$$Vc=a*Vd+b*TVd \quad (1)$$

Thus, the correction voltage [Vc] of the first air-fuel ratio detector 21 is calculated as the sum of a proportional term [a*Vd] and an integration term [b*TVd]. The proportional term [a*Vd] changes in accordance with the difference [Vd] between the standard voltage [Vref] and the measured voltage [V], and is directly affected by the current difference [Vd]. Accordingly, the proportional term [a*Vd] functions effectively to correct the standard output of the first air-fuel ratio 21 in the case that the standard output thereof deviates sharply. On the other hand, the integration term [b*TVd] changes in accordance with the accumulation of the differences [TVd] up to now. Accordingly, the integration term [b*TVd] functions effectively to correct the standard output of the first air-fuel ratio 21 in the case that the standard output thereof deviates gradually.

When the $O_2$ storage ability of the three-way catalytic converter 9 functions effectively, i.e., when the catalytic converter 9 has not deteriorated and is activated sufficiently, the amplitude of the variation of the air-fuel ratio in the exhaust gas downstream of the catalytic converter 9 becomes smaller than that upstream thereof and a cycle of the variation of the air-fuel ratio in the exhaust gas downstream of the catalytic converter 9 becomes longer than that upstream thereof. However, once the $O_2$ storage ability drops due to the deterioration or inactivity of the catalyst, the variation of the air-fuel ratio in exhaust gas downstream of the catalytic converter 9 becomes near to that upstream thereof, i.e., the amplitude thereof becomes large and the cycle thereof becomes short.

Therefore, a cycle of the variation of the air-fuel ratio in exhaust gas downstream of the three-way catalytic converter 9, i.e., an output reverse period [T] of the second air-fuel ratio detector 22 is measured so that a current $O_2$ storage ability can be determined. The larger the divergence of the standard output of the first air-fuel ratio detector 21 becomes or the lower the $O_2$ storage ability becomes, the larger becomes the difference between the air-fuel ratio, detected by the second air-fuel ratio detector 22, and the stoichiometric air-fuel ratio.

Accordingly, the first coefficient [a] which is used in the proportional term of the expression (1) is determined in accordance with the output reverse period [T] of the second air-fuel ratio detector 22, i.e., the current $O_2$ storage ability, so that the required correction voltage [Vc] can be calculated and thus the standard voltage of the first air-fuel ratio detector 21 can be precisely corrected thereby.

When the current $O_2$ storage ability is very low, the variation of the air-fuel ratio in the mixture virtually corresponds to the variation of the air-fuel ratio in exhaust gas downstream of the catalytic converter 9. Accordingly, the output reverse period [T] of the second air-fuel ratio detector 22 becomes relative short and thus the first coefficient [a] is made [0]. At this time, the difference between the air-fuel ratio in the exhaust gas detected by the second air-fuel ratio detector 22 and the stoichiometric air-fuel ratio becomes relative large. The variation of the air-fuel ratio in the mixture accounts for a large rate of the difference. The divergence of the standard output of the first air-fuel ratio detector 21 accounts for a small rate of the difference. Accordingly, the proportional term, which is directly affected by the difference, is made [0] and the correction voltage [Vc] is calculated from only the integration term. Therefore, the standard voltage of the first air-fuel ratio detector 21 can be corrected precisely and thus hunting of the air-fuel ratio caused by an excessive correction can be prevented.

Although the invention has been described with reference to specific embodiments thereof, it should be apparent that numerous modifications can be made thereto by those skilled in the art, without departing from the basic concept and scope of the invention.

I claim:

1. An air-fuel ratio control device for an internal combustion engine having a fuel injector and a catalytic converter, with an $O_2$ storage ability, arranged in an exhaust passage, comprising:

a first air-fuel ratio detector, for detecting an air-fuel ratio in exhaust gas, which is arranged in said exhaust passage upstream of said catalytic converter;

a second air-fuel ratio detector, for detecting an air-fuel ratio in exhaust gas, which is arranged in said exhaust passage downstream of said catalytic converter;

control means for controlling an amount of fuel injected by said fuel injector on the basis of an output of said first air-fuel ratio detector;

correction means for correcting a standard output of said first air-fuel ratio detector corresponding to the stoichiometric air-fuel ratio by a correction value determined on the basis of a difference between an air-fuel ratio detected by said second air-fuel ratio detector and the stoichiometric air-fuel ratio; and changing means for changing said correction value such that the lower a current $O_2$ storage ability is, determined on the basis of a variable which varies in accordance with said current $O_2$ storage ability, the smaller said correction value becomes.

2. A device according to claim 1, wherein said variable is an output reverse period while an output of said second air-fuel ratio detector reverses from one of the rich and lean sides to the other.

3. A device according to claim 1, wherein said correction value is calculated as a sum of a proportion term and an integration term, said proportion term being in direct proportion to said difference, said integration term being in direct proportion to an accumulation of said differences.

4. A device according to claim 3, wherein said changing means changes the coefficient of said proportion term to change said correction value.

5. A device according to claim 4, wherein said changing means makes said coefficient 0 when said current $O_2$ storage ability is very low.

* * * * *